United States Patent [19]

LaRue et al.

[11] Patent Number: 4,927,074

[45] Date of Patent: May 22, 1990

[54] DOCUMENT CONTAINER

[76] Inventors: John D. LaRue; John D. LaRue, Jr., both of 6720 Golf Dr., Dallas, Tex. 75205

[21] Appl. No.: 303,372

[22] Filed: Jan. 25, 1989

[51] Int. Cl.[5] ..... B65D 43/08

[52] U.S. Cl. ..... 229/125.21; 24/16 PB; 53/456; 53/485; 229/23 BT; 229/102

[58] Field of Search ..... 229/125.21, 125.22, 229/125.23, 125.37, 125.38, 165, 16 R, 23 BT, 52 B, 102, 23 R; 206/807; 24/16 PB; 53/456, 475, 485

[56] References Cited

U.S. PATENT DOCUMENTS

| | | | |
|---|---|---|---|
| Re. 27,391 | 6/1972 | Merser | 24/16 PB |
| 2,124,409 | 7/1938 | Andrews | 229/125.37 |
| 2,365,182 | 12/1944 | Ferguson | 229/125.37 |
| 2,418,963 | 4/1947 | Anderson, Jr. | 229/165 |
| 2,537,801 | 1/1951 | Swatsick | 229/125.21 |
| 2,561,979 | 7/1951 | George | 229/125.21 |
| 2,822,973 | 2/1958 | Armstrong et al. | 229/125.29 |
| 3,265,426 | 8/1966 | Brooks et al. | 24/16 PB |
| 3,366,496 | 1/1968 | Bomar et al. | 229/165 |
| 3,438,562 | 4/1969 | Connor et al. | 229/125.22 |
| 3,600,027 | 8/1971 | Noland | 24/16 PB |
| 3,667,666 | 6/1972 | Pryor | 229/16 R |
| 3,777,334 | 12/1973 | Countryman | 24/16 PB |
| 3,973,610 | 8/1976 | Ballin | 24/16 PB |
| 4,030,600 | 6/1977 | Heaps | 206/807 |
| 4,101,052 | 7/1978 | Dove | 229/23 R |
| 4,331,257 | 7/1989 | Taschner | 220/214 |
| 4,617,702 | 10/1986 | Diederich, Jr. | 24/16 PB |
| 4,768,704 | 9/1988 | Beckway et al. | 229/125.22 |

FOREIGN PATENT DOCUMENTS

| | | | |
|---|---|---|---|
| 873186 | 6/1971 | Canada | 229/165 |
| 2237466 | 2/1975 | France | 229/165 |

*Primary Examiner*—Gary Elkins

*Attorney, Agent, or Firm*—Worsham, Forsythe, Sampels & Wooldridge

[57] ABSTRACT

A container for storage and transportation of quantities of documents, wherein the box body is made of folded cardboard with thick end walls, and the lid is also made of folded cardboard, with a thick lip, and grommet holes in the lid are aligned with handle walls in the end walls. After the box is filled, and the lid is placed on the box, nylon cable ties are threaded through the grommet holes and handle holes to close the container.

31 Claims, 3 Drawing Sheets

DOCUMENT CONTAINER

PARTIAL WAIVER OF COPYRIGHT

All of the material in this patent application is subject to copyright protection under the copyright laws of the U.S. and of other countries. As of the first effective filing date of the present application, this material is protected as unpublished material.

However, permission to copy this material is hereby granted to the extent that the copyright owner has no objection to the facsimile reproduction by anyone of the patent document or patent disclosure, as it appears in the U.S. Patent and Trademark Office patent file or records, but otherwise reserves all copyright rights whatsoever.

BACKGROUND AND SUMMARY OF THE INVENTION

The present invention relates to containers for the storage and transportation of office records, particularly papers.

An immense volume of paper records is generated annually by the work of various office groups. Correspondingly, a large fraction of this volume of paper work must be shipped off to storage, or shipped from one office to another. Moreover, many offices find it convenient to maintain little-used records in bulk storage within the office, where those records can be accessed if needed. For all of these purposes, cardboard boxes are commonly used.

A commonly used type is described in U.S. Pat. No. 3,667,666 (which is hereby incorporated by reference), and is marketed by the Perma Product Company of Dallas, Tex. This design provides a cardboard box, which is cheap and sturdy. This box design has the advantages that:

1. Empty boxes can be sold folded flat. The user can easily fold the empty boxes into their usable form.

2. These boxes have a reasonably useful volume, typically in the neighborhood of a cubic foot. Thus, when these boxes are filled full of papers, their total weight will be in the neighborhood of 40 to 50 pounds. The construction of the boxes is strong enough to handle such weights reliably, without any risk of the boxes giving way in normal service.

3. The boxes have handle holes near the two ends. These handle holes permit the users to grab hold of the boxes and easily shift them around. These handle holes are too small to pose substantial risk of the contents escaping, and have the advantage that no external hardware is present, so that filled boxes can be stacked next to each other.

4. After a box has been filled, the lid fits over and around the top of the box body. Thus, closing the box does not require any flaps to intrude into the storage area. This makes it easier to close the boxes rapidly, and also minimizes the risk of the papers being disarranged by the closing operation. The use of a box with strong sidewalls and flat lids means that filled boxes can readily be stacked on top of each other.

Boxes of this type, while widely used, are not totally adequate, in that there is no simple, reliable means for securing the lid to the box for transport, or for prevention of pilferage and accidental loss.

When using this conventional design, after a box has been filled and its lid placed on it, users will normally tape down the lid when the box is to be shipped. However, to provide secure closure (so that the box will not open and spill papers during transport), a significant amount of adhesive tape must be used, even if the tape being used is quite strong. Moreover, in relation to the other operations described, the operation of thoroughly taping down the box lid is relatively slow.

As a structural material, cardboard has important advantages and important disadvantages. Cardboard is very cheap and lightweight, but its strength is quite directional: with normal corrugated cardboard, the in-plane shear strength will be quite strong in one direction, and not quite so strong in the orthogonal direction. Similarly, a sheet of such cardboard will bend quite easily along one axis, but not as easily along the opposite axis. These anisotropic characteristics can be overcome by using two-ply corrugated cardboard, but such cardboard is more expensive and not as lightweight. The present invention provides a secure and readily-accessible document handling container which efficiently exploits the strengths of cardboard structures, to provide a container which can easily hold several dozen of times its own weight. Thus, for document storage boxes, cardboard has the potential to be nearly an ideal material, if its disadvantages can be overcome. The teachings of the present invention can alternatively be applied to container designs which use other materials to reinforce a structure which is predominantly cardboard, or to designs which use lightweight honeycombed materials other than cardboard.

The present invention provides a modified cardboard document-handling box, and an improved method for closing such boxes. According to the present invention, the design described is modified by including a hole in the lid of the box, in a position such that the hole will be located above the handle holes when the lid is in place. After the lid is in place, a cable tie is threaded through the hole the handle hole, to securely attach the lid to the box. Preferably the hole is reinforced by a grommet (of metal or other material) to avoid tearout, but alternatively other reinforcements (such as a fiber or composite disk) could be used. Alternatively, depending on the strength of the material used for the lid, a simple hole could be used instead.

Cable ties are a convenient fastener which is cheap and readily available, and is very widely used in electrical assembly. Cable ties are normally formed of nylon, and have a high breaking strength for their size. (For example, cable ties have actually been used as temporary handcuffs by some police departments.) The cable tie has a series of angled steps along a large part of the length of the tie, and which has a formed structure with complementary angled steps at the other end. Thus, these two sections of angled steps form a pawl and ratchet structure, and, by inserting the free end of the cable tie into the formed end of the cable tie, the cable tie can be tightened so that it tightly fits the desired size.

Cable ties come in two types: reusable and non-reuseable. In the reusable, the user can manipulate the cable tie ends to disengage the pawl and ratchet mechanism, and loosen the tie. In the non-reusable type, there is no such disengagement mechanism, so that the cable tie, once it has been tightened, must be cut to remove it.

Thus, the present invention uses cable ties, which are a commonly available industrial part, to improve the capabilities of document storage boxes.

U.S. Pat. No. 4,331,257 to Taschner, which is hereby incorporated by reference, teaches the use of cable ties to prevent a mechanical latch on a medical instrument box from opening accidentally. The box's lid is held closed by the latch, not by the cable tie itself.

Thus, the present invention enables document boxes to be rapidly closed, securely transported, and rapidly opened.

Moreover, a further advantage of the present invention is that, after a box has been used for shipping or storage and is reopened, the sides of the box are not cluttered with tape. Thus, the box can still be used for "neat" storage.

BRIEF DESCRIPTION OF THE DRAWINGS

The present invention will be described with reference to the accompanying drawings, which show important sample embodiments of the invention and which are incorporated in the specification hereof by reference, wherein.

DESCRIPTION OF THE PREFERRED EMBODIMENT

The innovative teachings of the present application will be described with particular reference to the presently preferred embodiment. However, it should be understood that this embodiment is only one example of the many advantageous uses of the innovative teachings herein.

Figure 1:
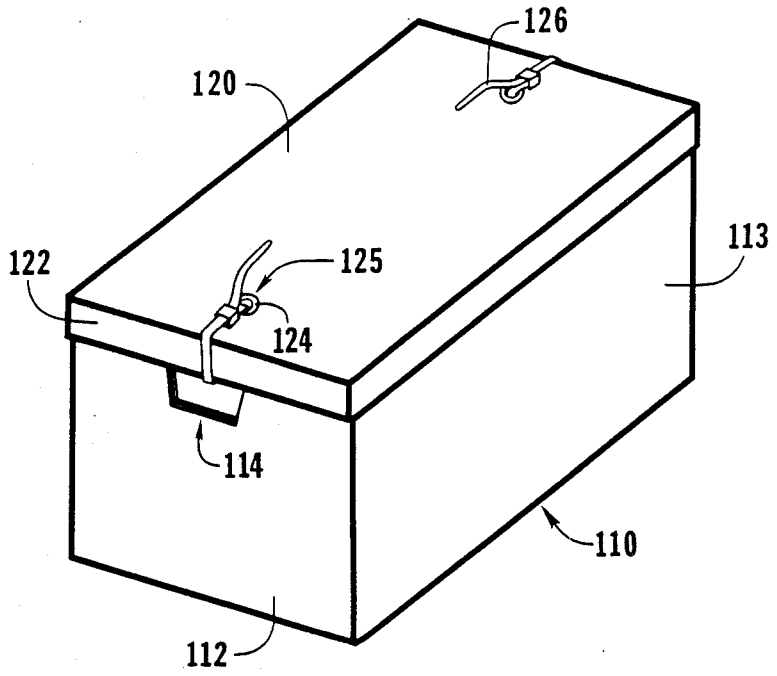
FIG. 1 shows an assembled and closed storage document storage box according to the present invention.

FIG. 1 shows a sample embodiment of the invention, in which a foldable-assembly cardboard document box has been closed, according to the present invention, using a cable tie threaded through a handle and grommet.

In this FIG., 110 is the body of the document box. In this sample embodiment this box has inside dimensions of 15.25 by 12 by 12 inches, although, of course, other sizes could be used. This box body is, in the presently preferred embodiment, made of cardboard which is 0.16 inches thick. The end walls of this box body include 3 plies of this cardboard, for extra strength. Both of the end walls 112 are pierced by a handle hole 114 which is big enough for a user to insert several fingers into. The handle holes 114 are placed far enough down on the end walls 112 that the entire maximum weight of a filled box can be supported by the handle holes. In the presently preferred embodiment, at least 1.75 inches of clear web is left above then handle holes 114 on the end walls 112, and the handle holes have maximum dimensions of 1.25 inches in height and 4 inches in width.

As noted, the lid 120 fits over the outside of the box body 110. In the presently preferred embodiment, the lip portion 122 of the lid 120 extends 2 inches down from the top of the end walls 112 and side walls 113 of the box body 110. In the presently preferred embodiment, the lid is made of cardboard which is approximately 0.125 inches thick, and the lip of the lid includes 2 plies of this cardboard.

Note that, in the presently preferred embodiment, the lid 120 also includes a grommet 124 set in a hole 125, which is located quite close to the lip 122 of the lid 120. The grommet 124, in the presently preferred embodiment, is a conventional brass grommet with an inside diameter of about 0.25 inches. (This dimension is selected for use with cable ties which have tongues which are approximately 0.19 inches wide.) The grommet 124 is located close to the lip 122, to provide extra strength. However, to avoid interference between the cable tie 126 and the top of the end wall 112, the center line of the grommet 124 needs to be offset from the lip 122 by a sufficient distance to allow for the thickness of the end wall 112. In the presently preferred embodiment, the center line of the grommet 124 (in hole 125) is located approximately 1 inch from the outer edge of the lid 120.

Thus, after the lid 120 is placed on top of a filled box body 110, two cable ties 126 are threaded through the grommet 124 and handle hole 114 at each of the end walls 112 of the box body 110, and are tightened to close the box. The box can now be transported in any desired fashion, without any particular care being taken, except for:

1. The box, being made of cardboard, should preferably not be allowed to get wet;
2. The boxes should not be stacked so heavily that the lower boxes will be crushed;
3. The boxes should preferably remain in an upright orientation, and not be tipped onto their sides or tops.

When the box arrives at its destination, the cable ties 126 can simply be snipped, and the box can immediately be opened. (In fact, for easier access to closely-packed boxes in storage, a box can be opened by snipping only one of the cable ties, so that the lid 120 can be tipped up a short distance to allow a user to peek inside the box.)

Alternatively, of course, reusable cable ties can be used instead of non-reusable cable ties. Reusable cable ties may be more advantageous for in-office storage applications. Non-reusable ties provide an extra element of security. An intruder, to gain access to the box, must cut or break the cable ties. For additional security, customized cable ties can be used, so that, if an intruder were to cut a tie and then replace it with a standard off-the-shelf cable tie, the intrusion could be detected.

Figure 2A:
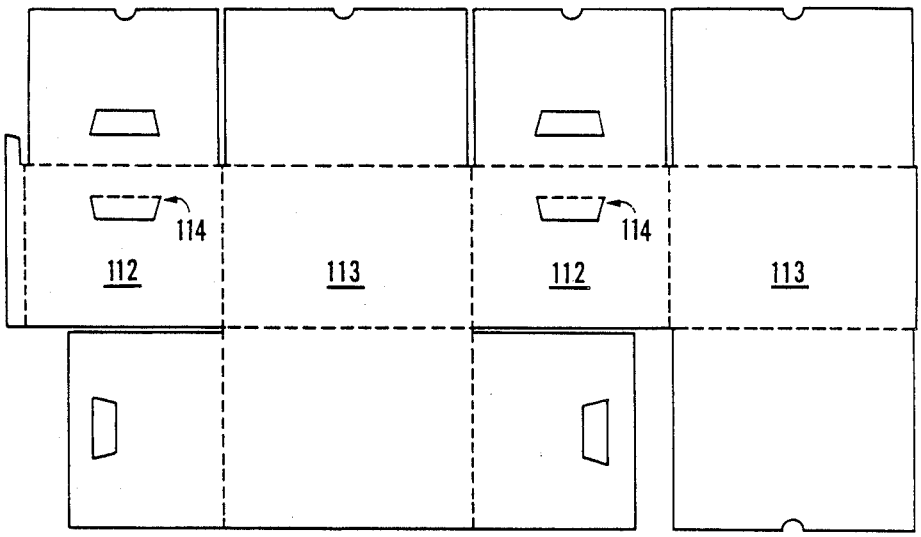
FIG. 2A shows a sample embodiment wherein the body of the storage box of FIG. 1 can be folded together from a flat-as-shipped cardboard structure. Similarly.
Figure 2B:
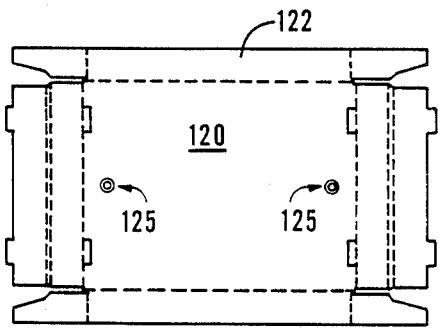
FIG. 2B shows how (in this sample embodiment) the lid of the storage box of FIG. 1 can be folded together from a flat-as-shipped cardboard structure.
Figure 3:
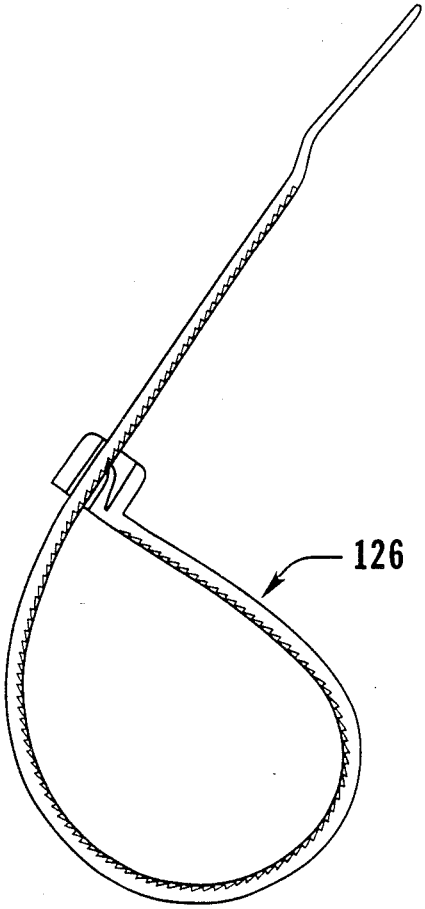
FIG. 3 shows a detailed view of the cable tie as used in the presently preferred embodiment.

FIG. 2A shows the preferred cardboard source of the box body 110, and FIG. 2B shows the shape from which the box lid is folded. In these drawings, dotted lines are used to indicate fold lines. From these drawings, it may be seen how the additional multi-ply thickness of the end walls 112, which is advantageous as described above, is achieved. The presently preferred embodiment uses only two grommeted holes in the lid, since two grommets gives sufficient strength for the presently preferred embodiment, and also provides convenience in rapid opening and closing. However, alternatively, space for more cable ties could be used if desired. For example, if it is contemplated that especially heavy loads may sometimes be used, additional grommeted holes could be added on the end walls (positioned so that cable ties could be threaded through the handle holes), or even on the side walls (with additional holes added in the side walls 113 for the cable ties to be threaded through). However, it should be noted that the threading of the cable ties through the handle holes is not accidental. The relatively large aperture provided by the handle holes means that the user can poke the tongue of the cable tie through the grommet in the lid, and then reach in through the handle hole to grab the end of the tongue and pull it out through the handle hole. Thus, it is most preferable that all cable tie locations be located where a relative large aperture (i.e. large enough for a user to easily reach through with two fingers) is located. In the box structure just described, this is preferably not located in the side wall, because the side wall includes a longer clear span of web, and interrupting this web with such a large hole would increase the chance of the side wall buckling when the box was lifted, by the handle holes in the end walls, under heavy load.

Normally, office storage needs will not be strictly limited to documents of standard size. Thus, the container provided by the present invention may also be used for storage or transportation of other items, such as books, large papers (such as maps or charts), phonograph records, computer backup tapes or floppy disks, stationery, etc. However, while many such alternative uses may be foreseen, and may well be advantageous, the container of the present invention is most especially advantageous for storing and/or transporting large quantities of paper documents.

As will be recognized by those skilled in the art, the innovative concepts described in the present application can be modified and varied over a tremendous range of applications, and accordingly their scope is not limited except by the allowed claims.

What is claimed is:

1. A document-handling container, comprising:

a box body, comprising end walls, side walls, and a floor, said end walls, side walls, and floor being folded from a continuous common sheet of cardboard, said end walls being thicker than said side walls of said box body, said end walls also including handle holes therein;

a lid, consisting essentially of a folded continuous sheet of cardboard, said lid having a peripheral lip thereon, said lid also including holes therein close to said lip, said lip including multiple plies of cardboard; and a ratcheting closure tie, which is dimensioned to be threaded completely through said handle hole, and through a respective corresponding one of said holes in said lid, and which can lock to itself;

said holes in said lid being located, within said lid, such that, when said lid is emplaced on said box body, plural respective ones of said holes are in proximity to respective corresponding ones of said handle holes.

2. The container of claim 1, wherein said lid includes exactly two of said holes.

3. The container of claim 1, wherein said holes in said lid are reinforced.

4. The container of claim 1, wherein said holes in said lid are reinforced by a material other than cardboard.

5. The container of claim 1, wherein said holes in said lid are reinforced by grommets.

6. The container of claim 1, wherein said cardboard of said box body is corrugated cardboard.

7. The container of claim 1, wherein the total thickness of said end walls of said box body is at least 0.3 inches.

8. The container of claim 1, wherein the enclosed volume of said box body is in the range of 0.75 to 2.0 cubic feet inclusive.

9. A document-handling container, comprising:

a box body, comprising end walls of a lightweight honeycombed material, side walls of said honeycombed material, and a floor, said end walls including handle holes therein;

a lid, comprising a top surface of a lightweight honeycombed material, and a lip positioned on said top surface, and holes located in said top surface near said lip; and a ratcheting closure tie, which is dimensioned to be threaded completely through said handle hole, and through a respective corresponding one of said holes in said lid, and which can lock to itself;

said holes in said lid being located, within said top surface, such that, when said lid is emplaced on said box body, plural respective ones of said holes are in proximity to respective corresponding ones of said handle holes.

10. The container of claim 9, wherein the enclosed volume of said box body is in the range of 0.75 to 2.0 cubic feet inclusive.

11. The container of claim 9, wherein said holes in said lid are reinforced.

12. The container of claim 9, wherein said holes in said lid are reinforced by grommets.

13. The container of claim 9, wherein said top surface of said lid is substantially flat.

14. The container of claim 9, wherein said end walls of said box body are thicker than said side walls thereof.

15. The container of claim 9, wherein said honeycombed material is corrugated cardboard.

16. The container of claim 9, wherein said top surface of said lid is made of the same honeycombed material as said end walls and said side walls of said box body.

17. The container of claim 9, wherein said floor is made of the same honeycombed material as said end walls and said side walls.

18. The container of claim 9, wherein said lip of said lid is made of the same honeycombed material as said top surface of said lid, and said lip of said lid is thicker than said top surface of said lid.

19. The container of claim 9, wherein said end walls consist essentially of a honeycombed material having anisotropic rigidity.

20. A document-handling container, comprising;

A box body, comprising end walls, side walls, and a floor said end walls, side walls, and floor being folded from a continuous common sheet of cardboard, said end walls being thicker than said side walls of said box body, said end walls also including handle holes therein;

a lid, consisting essentially of a folded continuous sheet of cardboard.

said lid having a peripheral lip thereon, said lid also including holes therein close to said lip, said lip including multiple plies of cardboard;

said holes in said lid being located, within said lid, such that, when said lid is emplaced on said box body, plural respective ones of said holes are in proximity to respective corresponding ones of said handle holes; and further comprising a ratcheting closure tie, which is threaded through said hole in said lid and through said handle hole and locked to itself.

21. A method of handling documents, comprising the steps of:

providing a box body, comprising end walls of a lightweight honeycombed material, side walls of said honeycombed material, and
a floor,
said end walls including handle holes therein and being thicker than said side walls;
providing a lid, consisting essentially of
a top surface of a lightweight honeycombed material, and
a lip positioned on said top surface, and
holes located in said top surface near said lip, such that, when said lid is emplaced on said box body, plural ones of said holes are in proximity to respective ones of said handle holes;
placing desired documents into said box body;
placing said lid onto said box body;
threading at least one cable tie through a respective one of said holes of said lid and completely through a respective corresponding one of said handle holes of said end wall, and closing said cable tie to close said box.

22. The method of claim 21, wherein said top surface of said lid is substantially flat.

23. The method of claim 21, wherein said lightweight honeycombed material of said box body is corrugated cardboard.

24. The method of claim 21, wherein said honeycombed material is corrugated cardboard.

25. The method of claim 21, wherein said cable ties are non-reusable cable ties.

26. The method of claim 21, wherein said cable ties each have a minimum cross-section of at least 2 square millimeters.

27. The method of claim 21, wherein said cable ties are nylon.

28. The method of claim 21, wherein said cable ties are reusable cable ties.

29. The method of claim 21, wherein the total thickness of said end walls of said box body is at least 0.4 inches.

30. The method of claim 21, wherein said lid includes exactly two of said holes.

31. The method of claim 21, wherein said top surface of said lid is made of the same honeycombed material as said end walls and said side walls of said box body.

* * * * *